US010113726B1

(12) United States Patent
Veloskey et al.

(10) Patent No.: US 10,113,726 B1
(45) Date of Patent: Oct. 30, 2018

(54) RADIALLY ADJUSTABLE LANDSCAPE LIGHT FIXTURE MOUNT

(71) Applicant: Hunter Industries, Inc., San Marcos, CA (US)

(72) Inventors: Thomas E. Veloskey, San Marcos, CA (US); Dillon J. Rak, San Diego, CA (US); Michael A. Huelsman, Carlsbad, CA (US)

(73) Assignee: Hunter Industries, Inc., San Marcos, CA (US)

( * ) Notice: Subject to any disclaimer, the term of this patent is extended or adjusted under 35 U.S.C. 154(b) by 358 days.

(21) Appl. No.: 14/991,701

(22) Filed: Jan. 8, 2016

(51) Int. Cl.

| | |
|---|---|
| ***F21V 21/30*** | (2006.01) |
| ***F21V 21/08*** | (2006.01) |
| *F21W 121/00* | (2006.01) |
| *F21W 131/10* | (2006.01) |

(52) U.S. Cl.
CPC ..... *F21V 21/30* (2013.01); *F21V 21/0824* (2013.01); *F21W 2121/00* (2013.01); *F21W 2131/10* (2013.01)

(58) Field of Classification Search
CPC ..... F21V 21/30; F21V 21/0824; F21W 2131/109
See application file for complete search history.

(56) References Cited

U.S. PATENT DOCUMENTS

| | | | | |
|---|---|---|---|---|
| 3,104,064 | A | 9/1963 | Bellek | |
| 3,519,726 | A | 7/1970 | Ewing | |
| 4,290,094 | A | 9/1981 | Jensen | |
| 4,974,134 | A | 11/1990 | Bourne | |
| 5,337,993 | A | 8/1994 | Hersman | |
| 5,599,091 | A * | 2/1997 | Kira | F21V 21/30 362/269 |
| 5,649,760 | A | 7/1997 | Beadle | |
| 5,655,829 | A | 8/1997 | Lin et al. | |
| 6,575,591 | B1 | 6/2003 | De Lany | |
| 6,583,700 | B1 | 6/2003 | Beadle | |
| 6,612,720 | B1 | 9/2003 | Beadle | |
| 7,470,895 | B1 | 12/2008 | Cramer et al. | |
| 2005/0103378 | A1 * | 5/2005 | Pu | F21S 9/032 136/244 |
| 2005/0135101 | A1 * | 6/2005 | Richmond | F21S 9/037 362/276 |

(Continued)

OTHER PUBLICATIONS

FXLuminaire Price List 2015, Architectural and Landscaping Lighting, The Intersection of Art & Engineering, Hunter Industries, Inc., dated 2014 in 3 pages.

*Primary Examiner* — Jong-Suk (James) Lee
*Assistant Examiner* — Christopher E Dunay
(74) *Attorney, Agent, or Firm* — Knobbe, Martens, Olson & Bear, LLP

(57) ABSTRACT

A radially adjustable landscape light fixture mount includes a mounting plate having a female threaded portion for affixing a light fixture thereto and a separate mounting stake having a locking lever. The mounting stake has a recessed portion for receiving the mounting plate and affixed light fixture. The locking lever has an open position and a closed position. When the locking lever is in the open position the radial position of the mounting plate and affixed light fixture can be adjusted relative to the mounting stake by a user. In the closed position the locking lever fixes the radial position of the mounting plate.

19 Claims, 10 Drawing Sheets

(56) References Cited

U.S. PATENT DOCUMENTS

2007/0091585 A1* 4/2007 Hedman ..... B05B 17/08
362/96
2007/0171655 A1* 7/2007 Lai ..... F21V 21/0824
362/362
2009/0122564 A1* 5/2009 Beadle ..... F21S 8/081
362/431
2011/0303764 A1* 12/2011 Roth ..... B05B 15/10
239/289
2014/0099093 A1* 4/2014 Johnson, Sr. ..... G03B 17/561
396/428
2014/0301066 A1* 10/2014 Inskeep ..... F21S 9/02
362/183
2015/0260385 A1* 9/2015 Brynjolfsson ..... F21V 23/045
315/152
2017/0191631 A1* 7/2017 Lentine ..... F21S 10/007

* cited by examiner

Section B-B

RADIALLY ADJUSTABLE LANDSCAPE LIGHT FIXTURE MOUNT

BACKGROUND OF THE INVENTION

Field of the Invention

The present invention relates to light fixture mounts, and more particularly, to radially adjustable landscape light fixture mounts for installation around lawns and gardens of residential and commercial properties.

Description of the Related Art

Outdoor landscape lighting is popular for security, aesthetic, safety, and other reasons. It is known in the outdoor lighting industry to mount a landscape light fixture on the top of a mounting stake whose lower end is planted in the ground. This secures the light fixture in a fixed position and keeps it in place.

Typical commercially available landscape light fixture mounts are essentially a stake with a lower pointed end and a threaded top portion for receiving a light fixture. To install this type of landscape light fixture mount a user will secure the light fixture to the stake and place the stake in the ground. Alternatively, a user might first pound the stake into the ground before affixing the light fixture.

SUMMARY OF THE INVENTION

Many light fixtures include a simple pivot to allow a user to aim the light fixture at the intended feature. This can be done by adjusting the angle of the light fixture relative to the horizon. Making radial adjustments to the position of the light fixture is not as simple. Often a user will loosely screw the light fixture into the stake and continue to tighten it until the radial position is correct. In other cases, a user may attempt to install the stake at the correct radial position with the light fixture attached. Then in order to adjust the radial position of the light fixture the stake must be pulled out from the ground and repositioned.

Light fixtures are often installed during daylight hours. However, a final adjustment is normally required when it is dark to insure that the light fixture is highlighting the correct feature. With typical commercially available light fixtures this means either relocating the stake, or loosening or tightening the threads of the fixture in the stake. In either case it is easy for an unauthorized person to simply reach down and adjust the light fixture such that it is in an undesirable radial position, thereby disrupting the intended lighting design.

In accordance with some embodiments, a radially adjustable landscape light fixture mount includes a mounting plate having a female threaded portion for affixing a light fixture thereto and a separate mounting stake having a locking lever. The mounting stake has a recessed portion for receiving the mounting plate and affixed light fixture. The locking lever has an open position and a closed position. When the locking lever is in the open position the radial position of the mounting plate and affixed light fixture can be adjusted relative to the mounting stake by a user. In the closed position the locking lever fixes the radial position of the mounting plate.

In accordance with some embodiments, a radially adjustable landscape light fixture mount can comprise a mounting plate having a plurality of teeth on an outer surface and a female threaded portion configured to receive a male threaded portion of a light fixture. The radially adjustable landscape light fixture mount can further comprise a mounting stake for positioning a light fixture in a landscape. The mounting stake can have a top portion having a recess configured for receiving the mounting plate, and the mounting plate can be separate and removable from the mounting stake. The mounting stake can also have a tab located on an inner portion of the recess. The tab can engages with the teeth of the mounting plate when the mounting plate is positioned within the recess and can be configured to allow for an incremental adjustment of a radial position of the mounting plate. The mounting stake can also have a locking lever which is hingedly coupled to the top portion of the mounting stake. The locking lever can have an open position and a closed position. The locking lever can include a locking portion that engages with one or more of the teeth to fix the radial position of the mounting plate when the mounting plate is positioned within the recess and the locking lever is in the closed position. The locking lever can also have a locking tab which is configured to selectively fix and un-fix the locking lever in the closed position. The radially adjustable landscape light fixture mount can be configured such that inserting the mounting plate into the recess establishes a longitudinal and latitudinal position of the mounting plate relative to the mounting stake. The mounting plate can be rotatable in place within the recess to provide incremental adjustment until the locking lever is fixed in the closed position.

According to some embodiments of the radially adjustable landscape light fixture mount, the tab may include an arm attached to the top portion and a protrusion extending from the arm to sit between the teeth of the mounting plate. The arm can be configured to deflect to allow for the protrusion to pass over a tooth during an incremental radial adjustment of the mounting plate.

In some variants, the outer surface of the mounting plate can include a retaining groove and the locking lever can include a retainer configured to fit in the retaining groove to secure the mounting plate in the recess. In some variants the mounting plate can include a centrally located aperture extending through an entire thickness of the mounting plate which is configured to allow a wire connected to a light fixture to pass therethrough.

According to some embodiments, the mounting stake can include a slot extending from a top edge of the top portion to an area below the recess in the top portion. The slot can be configured to allow the wire connected to the light fixture to pass therethrough.

In some embodiments, a landscape lighting system is disclosed which can comprise a radially adjustable landscape light fixture mount and a light fixture which may comprise a male threaded portion that can be coupled to the female threaded portion of the mounting plate.

In some variants, the mounting stake can be configured to be inserted into soil without the mounting plate attached. The mounting plate can be configured to receive a light fixture prior to being inserted into the recess in the top portion of the mounting stake.

In accordance with some embodiments, a radially adjustable landscape light fixture mount can include a mounting plate and a mounting stake. The mounting plate may comprise a light fixture attachment portion configured to fixedly receive a light fixture. The mounting stake can be configured to receive the mounting plate. The mounting stake can also include a lock which may have a first position and a second position. The lock can be configured to secure the mounting plate in the mounting stake and to fix a radial position of the mounting plate in the second position. In some variants the mounting plate can be separate and removable from the mounting stake and can be rotatable when received by the mounting stake.

According to some embodiments, the light fixture mounting plate can include a plurality of teeth. In some variants the top portion can include a tab that engages with the teeth of the mounting plate to allow for an incremental adjustment of the radial position of the mounting plate when in the recess. In some embodiments the locking lever can include a retaining tab that engages with the teeth of the mounting plate. According to some embodiments locking lever can comprise a rotatable C-clip which can have a locking tab configured to engage with a corresponding portion of the mounting stake to thereby secure the locking lever in the closed position. In some embodiments the mounting plate may comprise a centrally located aperture extending through an entire thickness of the mounting plate to receive and pass through a wire connected to a light fixture. In some variants the mounting stake can have a slot extending from a top edge of the top portion to below the recess. The slot can be configured to allow the wire connected to the light fixture to pass through the slot. According to some embodiments a landscape lighting system can include a radially adjustable landscape light fixture mount and a light fixture which can be configured to be fixedly attached to the light fixture attachment portion of the light fixture mounting plate.

According to some embodiments, a radially adjustable landscape light fixture mount can comprise a mounting plate and a mounting stake. The mounting plate may comprise an attachment portion for fixedly receiving a light fixture, an outer portion comprising a plurality of teeth, and a retaining groove. The mounting stake may comprise a top portion configured for receiving the mounting plate, a locking lever, and a retainer portion. The locking lever can have an open position and a closed position and can include a locking portion that may engage with one or more teeth of the plurality of teeth in the closed position to fix a radial position of the mounting plate. The retainer portion may fit into the retaining groove of the mounting plate when the mounting plate is received at the top portion and the locking lever is in the closed position to fix and secure the mounting plate at the top portion. The mounting stake can also include a tab that may engage with the teeth of the mounting plate when the mounting plate is received at the top portion. The tab can allow for an incremental adjustment of the radial position of the mounting plate while the locking lever is in the open position. The mounting plate can be separate and removable from the mounting stake. The light fixture mount can further be configured such that positioning the mounting plate at the top portion may establish a longitudinal and latitudinal position of the mounting plate relative to the mounting stake. The mounting plate can be rotatable until the locking lever is fixed in the closed position.

In some variants, the top portion can be configured for receiving the mounting plate comprises a recess. According to some embodiments a landscape lighting system can include a radially adjustable landscape light fixture mount and a light fixture configured to be fixedly attached to the attachment portion of the mounting plate. In some variants the mounting stake may be configured to be inserted into soil without the mounting plate attached and the mounting plate may be configured to receive a light fixture prior to being inserted into the recess in the top portion of the mounting stake.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

DETAILED DESCRIPTION

Figure 1:
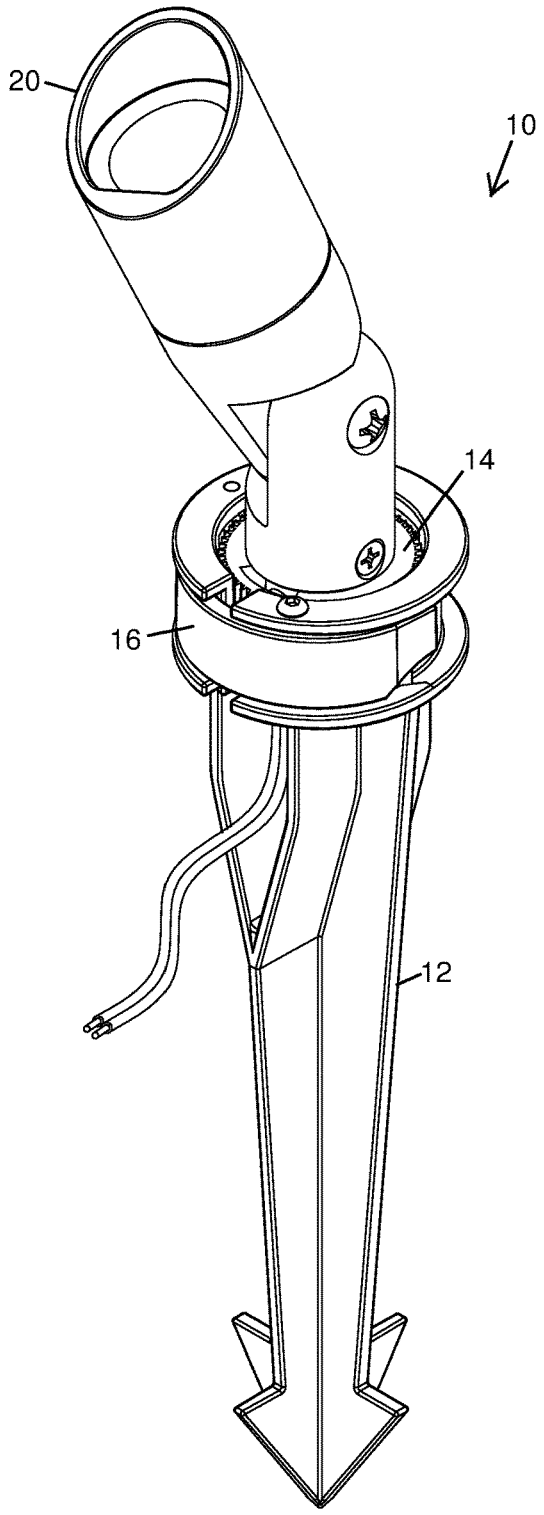
FIG. 1 is an isometric view of a light fixture mount. An exemplary light fixture is shown mounted to the light fixture mount of FIG. 1.
Figure 2:
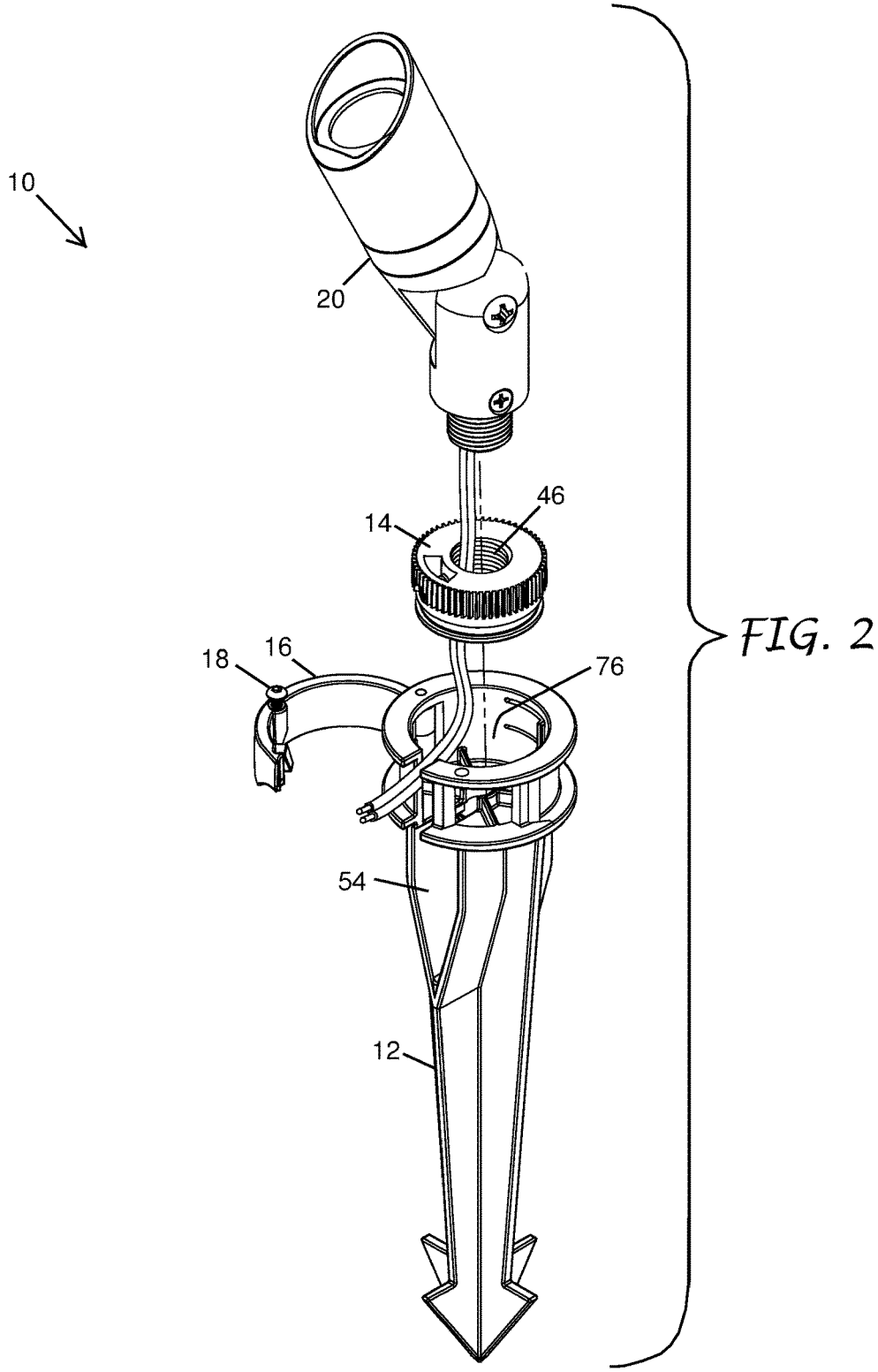
FIG. 2 shows an exploded isometric view of the light fixture mount and light fixture as depicted in FIG. 1.

Referring to FIGS. 1 and 2, a radially adjustable landscape light fixture mount 10 with exemplary light fixture 20 is shown. The light fixture mount 10 can include a mounting stake 12 and a mounting plate 14. The illustrated radially adjustable landscape light fixture mount 10 has a mounting plate 14 which includes a central portion that can receive and secure a light fixture 20. An exemplary light fixture 20 is shown affixed to the mounting plate 14 in FIG. 1. The mounting plate 14 with the affixed light fixture 20 can be positioned in a recessed portion 76 of the mounting stake 12. The mounting stake 12 can include a lock which may include, for example, a locking lever 16, to secure the mounting plate in place.

The lock may comprise a locking lever 16. The lock can have a first position and a second position. In some embodiments, for example where the lock includes a locking lever 16, the first position may be an open position and the second position may be a closed position. When the lock is in the first position the radial position of the mounting plate 14 and affixed light fixture 20 can be adjusted by a user. Once the light fixture 20 has been rotated to a desired radial position the user can secure the lock in the second position. In this position the lock secures the radial position of mounting plate 14, thereby also securing the radial position of the affixed light fixture 20. In those embodiments where the lock includes a locking lever 16, when the locking lever 16 is in the first or open position the radial position of the mounting plate 14 and affixed light fixture 20 can be adjusted by a user. This is accomplished by rotating the mounting plate 14 and affixed light fixture 20 within the recessed portion 76 of the mounting stake 12. For example, a user may grab and rotate the light fixture 20, which by virtue of being affixed to the mounting plate 14, causes both the mounting plate 14 and light fixture 20 to rotate relative to the mounting stake 12.

Once the light fixture 20 has been rotated to a desired radial position the user can secure the locking lever 16 in the second or closed position. The locking lever 16 is depicted in the closed position in FIG. 1. In this position the locking lever 16 secures the radial position of mounting plate 14, thereby also securing the radial position of the affixed light fixture 20.

In use, referring now to FIG. 2 and by way of example only, an end of the mounting stake 12 is inserted into the ground by a user at a desired location. Typically a user will insert the mounting stake 12 into soil, for example, a lawn or yard, although any relatively soft and penetrable body will suffice. Additionally, a light fixture 20 is securely affixed to the mounting plate 14 via an attachment portion 46. Any wires which emanate from the light fixture 20 can be passed through the attachment portion 46. The mounting plate 14 is removable from the mounting stake 12 and can be separate and remote from the mounting stake 12. In the embodiment depicted in FIG. 2, the light fixture 20 has a male threaded portion which corresponds to a female threaded attachment portion 46 of the mounting plate 14. The light fixture 20 is screwed into the attachment portion 46 so that it is securely affixed to the mounting plate 14 with any wire passing through the bottom of the mounting plate 14. The mounting plate 14 with affixed light fixture 20 is then inserted into the recessed top portion 76 of the mounting stake 12 while the locking lever 16 is in the open position. The light fixture 20 wire or wires which pass through the mounting plate 14 are likewise passed through a slot 54 in the mounting stake 12 when the mounting plate 14 is inserted to thereby allow connection to a desired connection point. A user may then adjust the radial position of the mounting plate 14 and light fixture 20 relative to the mounting stake 12. Once a desired radial position has been obtained the user will rotate the locking lever 16 into the closed position (FIG. 1) to thereby fix the radial position of the mounting plate 14 and light fixture 20, and secure the mounting plate 14 in the recessed portion 76 of the mounting stake 12.

Alternatively, the light fixture 20 is securely affixed to the mounting plate 14, and the mounting plate 14 is then inserted into the recessed top portion 76 of the mounting stake 12 while the locking lever 16 is in the open position. The locking lever 16 is then rotated into the closed position and the radially adjustable landscape light fixture mount 10 is inserted into the ground at a desired location. After the radially adjustable landscape light fixture mount 10 has been inserted into the ground, the radial position of the light fixture 20 can be adjusted by a user. This is accomplished by rotating the locking lever 16 into the open position and then rotating the mounting plate 14 and affixed light fixture 20 in the recessed portion 76 of the mounting stake 12. Once a desired radial position has been obtained the user can rotate the locking lever 16 back into the closed position.

Further, the mounting plate 14 may be rotatable within the mounting stake 12, but may not be removable therefrom. A user can affix the light fixture 20 to the mounting plate 14 as described above while the mounting plate 14 is held in the mounting stake 12 and the locking lever 16 is in the closed position. Any wires emanating from the light fixture 20 can be passed through the attachment portion 46 and slot 54 to thereby allow connection to a desired connection point. The radial position of the light fixture 20 and mounting plate 14 may be adjusted as described above.

Figure 3:
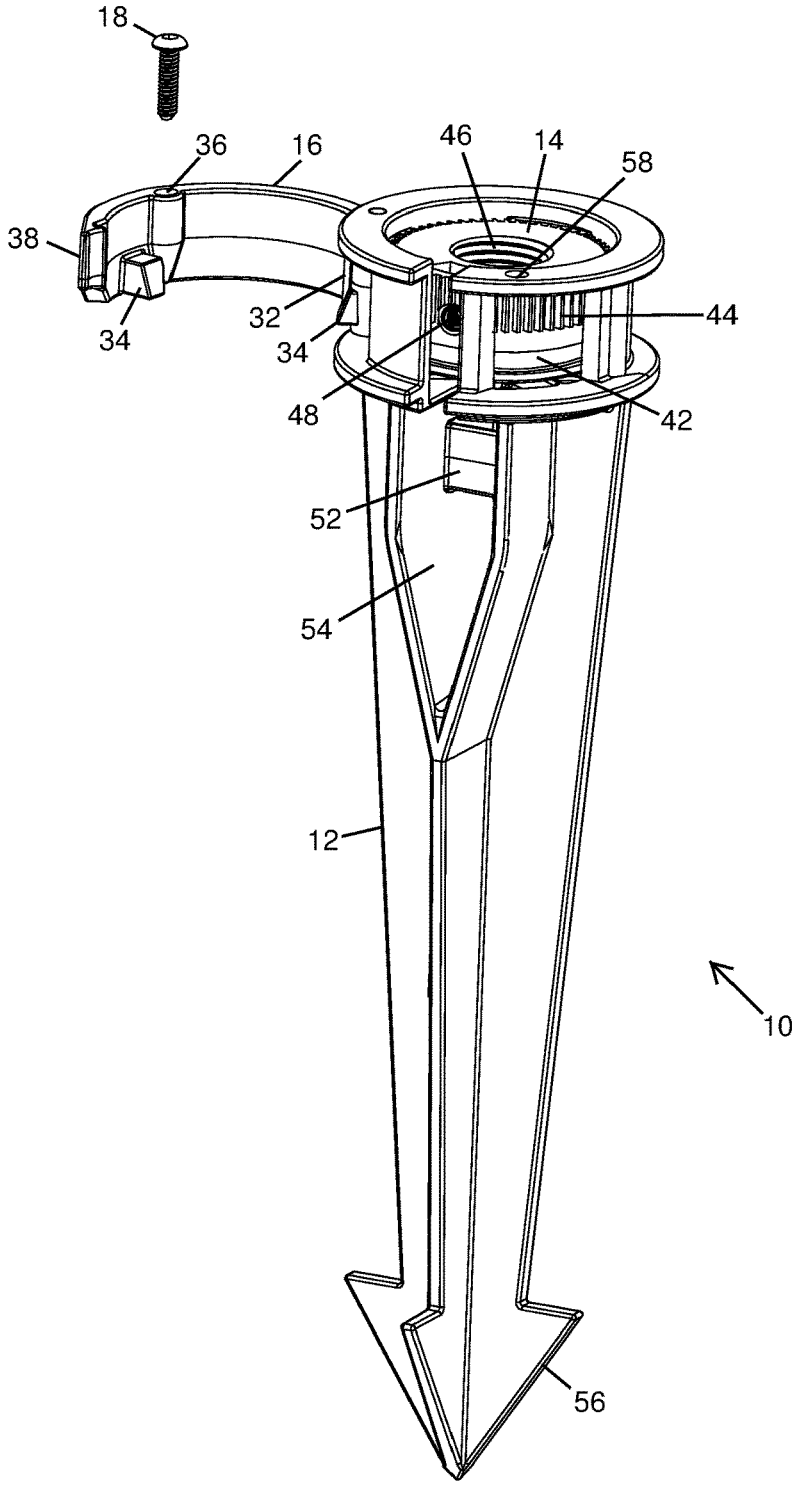
FIG. 3 is an oblique view of the light fixture mount of FIG. 1 showing the locking lever in an open position with the locking lever securing screw shown removed from the locking lever.

The locking lever 16 may be a C shaped clip which is hingedly attached to the mounting stake 12 as shown in FIG. 3. The locking lever 16 may further include a locking portion 32 and/or at least one retainer portion 34. The locking portion 32 is configured to engage with an outer portion of the mounting plate 14 when the locking lever 16 is in a closed position to thereby fix the radial position of the mounting plate 14. The outer portion of the mounting plate 14 may include a plurality of teeth 44, which are engaged by the locking portion 32 as will be described in more detail below. The retainer portion 34, which will also be described in more detail below, is configured to fit into an optional retaining groove 42 in the mounting plate 14 when the locking lever 16 is in the closed position to thereby secure the mounting plate 14 in the recessed portion 76 of the mounting stake 12.

Additionally, as depicted in FIG. 3, the radially adjustable landscape light fixture mount 10 may also include a fastener 18. The fastener 18 can prevent the mounting plate 14 from being rotated. The fastener 18 can connect to one or more of the mounting plate 14, the locking lever 16 and the housing surrounding the recessed portion 76, among other features. As illustrated, the fastener 18 is a securing screw 18 with a male threaded portion which corresponds to a securing screw receiving portion 36 of the locking lever 16. When the locking lever 16 is in the closed position the securing screw 18 can be inserted through a securing portion 58 of the mounting stake 12 and screwed into the securing screw receiving portion to secure the locking lever 16 in the closed position. Such a securing screw 18 may be useful, for example, for preventing unauthorized users from moving the locking lever 16 into the open position and adjusting the radial position of the light fixture 20.

Figure 5:
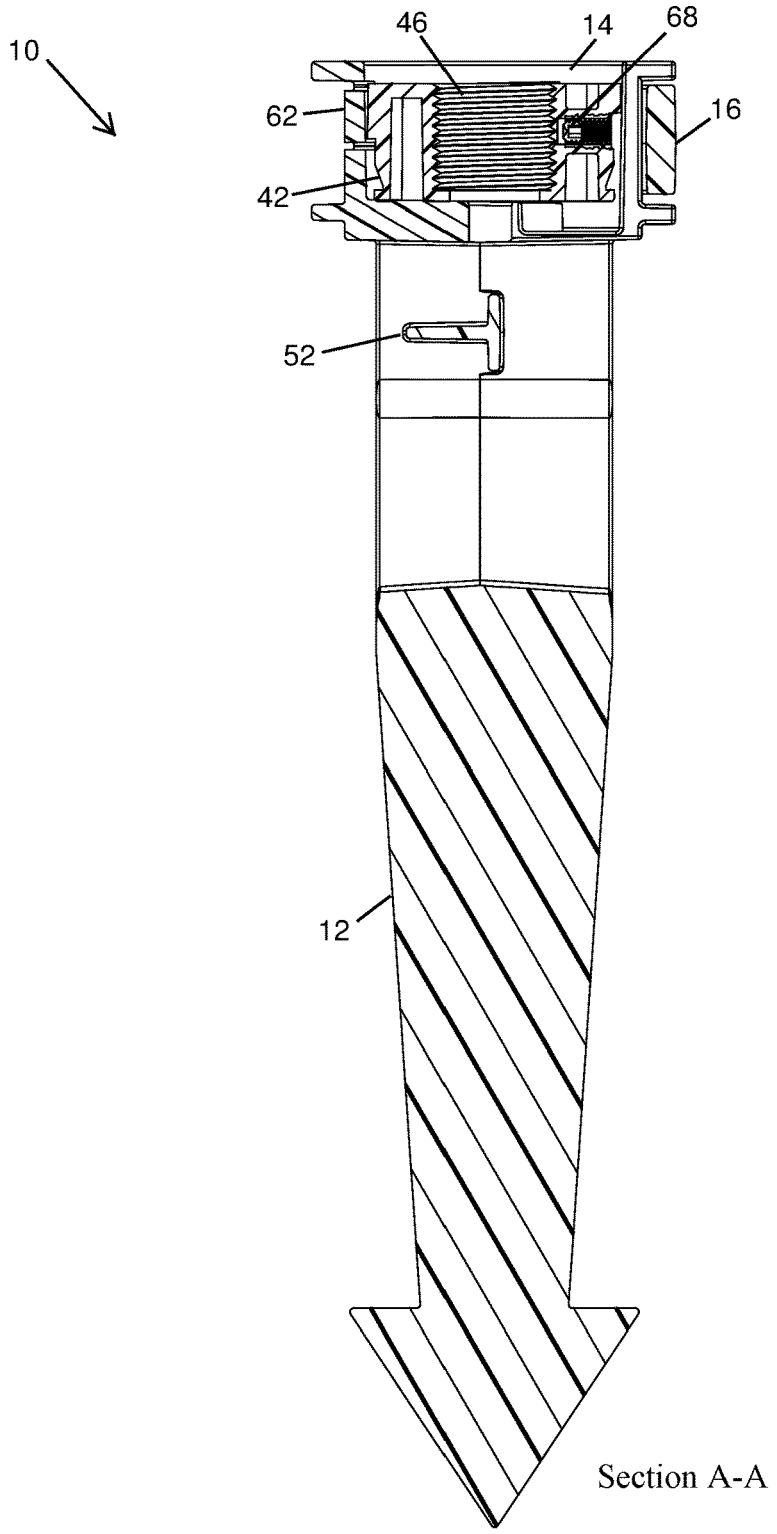
FIG. 5 shows a sectional view along line A-A of FIG. 4.
Figure 7:
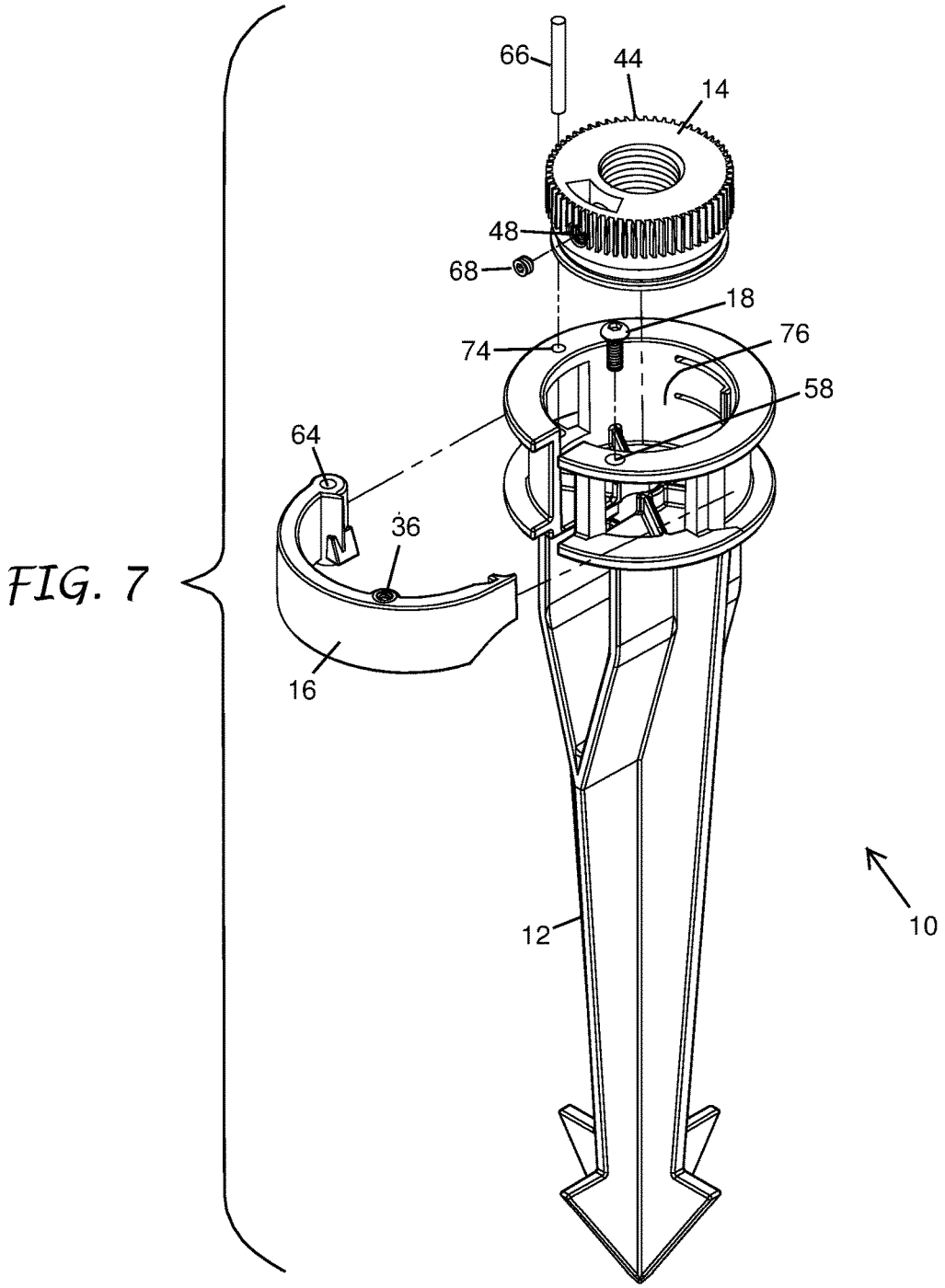
FIG. 7 is an exploded isometric view of the light fixture mount of FIG. 1.

Although the light fixture 20 can be securely affixed to the mounting plate 14 via the attachment portion 46, the light fixture 20 may be further secured to the mounting plate 14 by an optional locking screw 68 (best seen in FIGS. 5 and 7). The male threaded locking screw corresponds to the female threaded locking portion 48 of the mounting plate 14 depicted in FIG. 3. In use, the locking screw 68 is screwed into the locking portion 48 until it abuts and presses against the threads of the light fixture 20 within the attachment portion 46. The pressure exerted by the locking screw on the light fixture 20 prevents the light fixture 20 from being unscrewed from the attachment portion 46 of the mounting plate 14.

Figure 8:
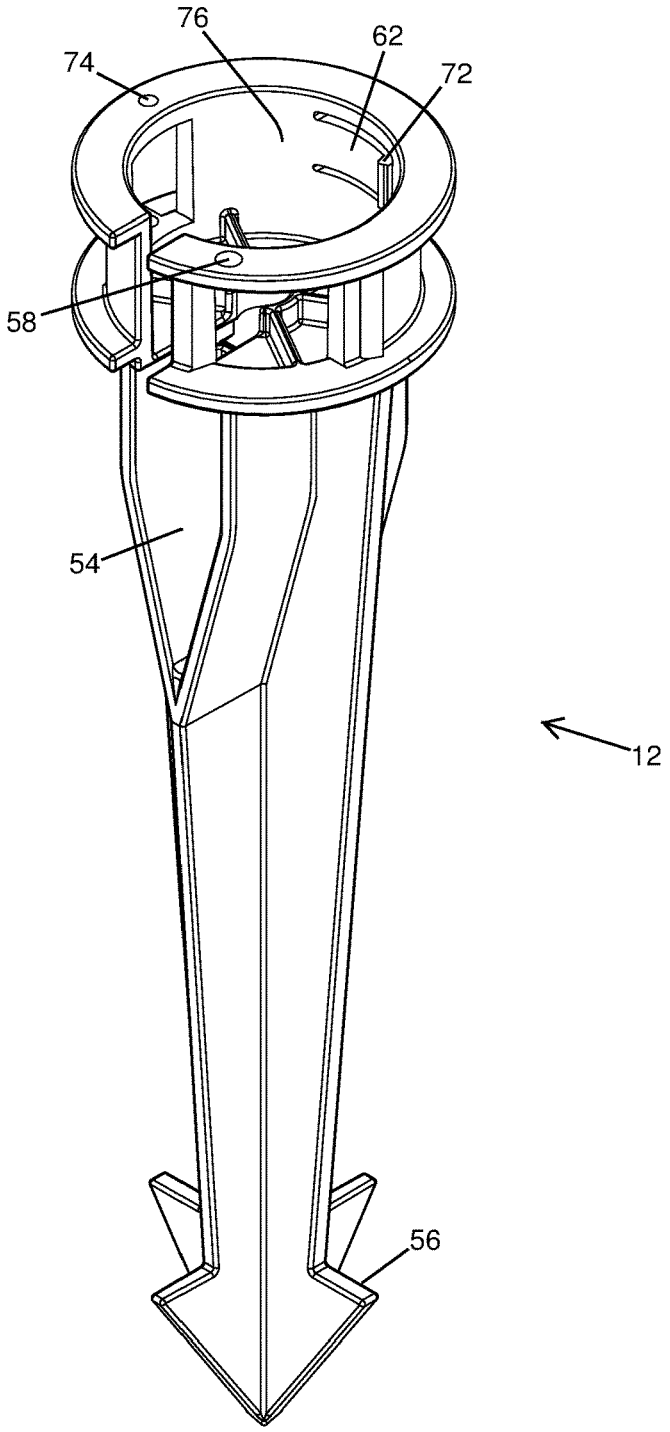
FIG. 8 depicts an isometric view of the mounting stake of the light fixture mount of FIG. 1.

The mounting stake 12 as depicted in FIG. 8 includes a pointed end 56 opposite the recessed portion 76. The pointed end 56 is configured to allow the mounting stake 12 to be easily and securely inserted into soil, or any other relatively soft, penetrable body for positioning. Although the radially adjustable landscape light fixture mount 10 is typically inserted into the ground, for example a lawn or yard, it is envisioned that the radially adjustable landscape light fixture mount 10 may be positioned anywhere a user may desired a landscape light fixture. Thus, alternatively, the mounting stake 12 may not include a pointed end 56 and may include some other attachment means for securing the radially adjustable landscape light fixture mount 10 in a desired location. For example an end of the mounting stake 12 may include a suction cup, a male threaded portion, a female threaded portion, a through hole for receiving a bolt, etc. The attachment means is not limited to the particular examples disclosed herein and other means can be used.

Figure 4:
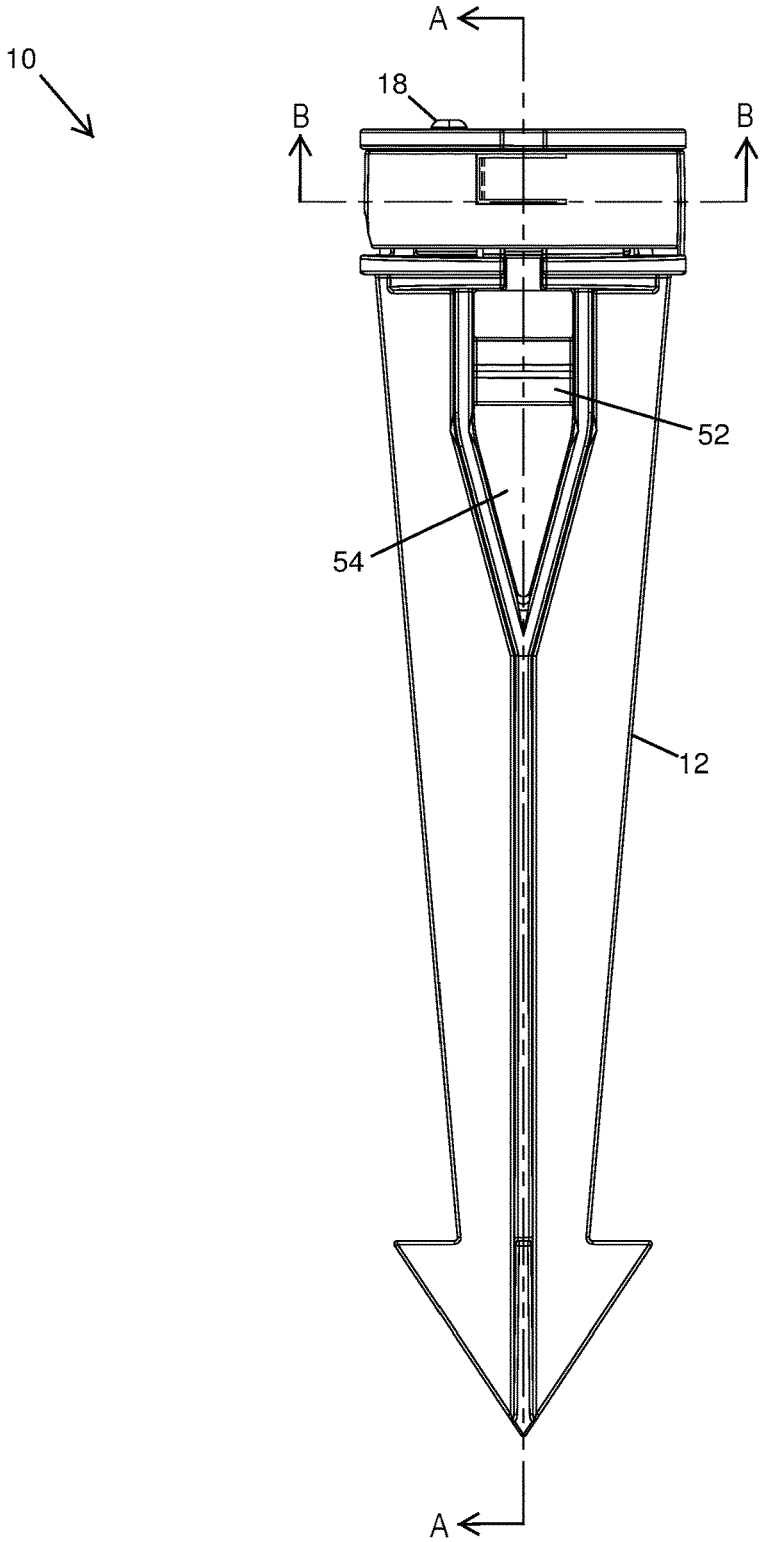
FIG. 4 is a side elevation view of the light fixture mount of FIG. 1.

FIG. 4 shows a side-view of the radially adjustable landscape light fixture mount 10 depicted in FIGS. 1-3. The mounting stake 12 includes a slot 54 that extends below the locking lever 16 that can allow a wire or wires connected to the light fixture 20 to pass therethrough. As illustrated, the mounting stake 12 includes a slot 54 extending from a top edge of the mounting stake 12 to a portion of the mounting stake 12 below the locking lever 16. The slot 54 extends to a central portion of the mounting stake 12 such that it is positioned below the attachment portion 46 when the mounting plate 14 is in the recessed portion 76 of the mounting stake 12. The slot 54 allows the wire or wires connected to the light fixture 20 to pass therethrough when the light fixture 20 is affixed to the mounting plate 14 and in the recessed portion 76 of the mounting stake 12. In this way the light fixture 20 can be optionally be connected to a remote power source. The slot 54 may also include a cross-brace 52, which extends from one side of the slot 54 to the other. The cross-brace 52 is configured to provide structural support to the mounting stake 12.

As shown in FIG. 5, the cross-brace 52 may have a "T" shaped cross-section to provide structural integrity to the mounting stake 12. Other cross-sectional shapes are expressly contemplated, for example an "X" shape, or "Y" shape. The cross-sectional shape of the cross-brace 52 is not limited to the particular examples disclosed herein and other shapes can be used. FIG. 5 further depicts the attachment portion 46 of the mounting plate 14, which may include a female threaded portion. The female threaded portion extends from a top surface of the mounting plate 14 through the body of the mounting plate 14. The female threaded portion may extend through the entire body of the mounting plate 14, or the female threaded portion may extend partially through the body of the mounting plate 14.

Figure 6:
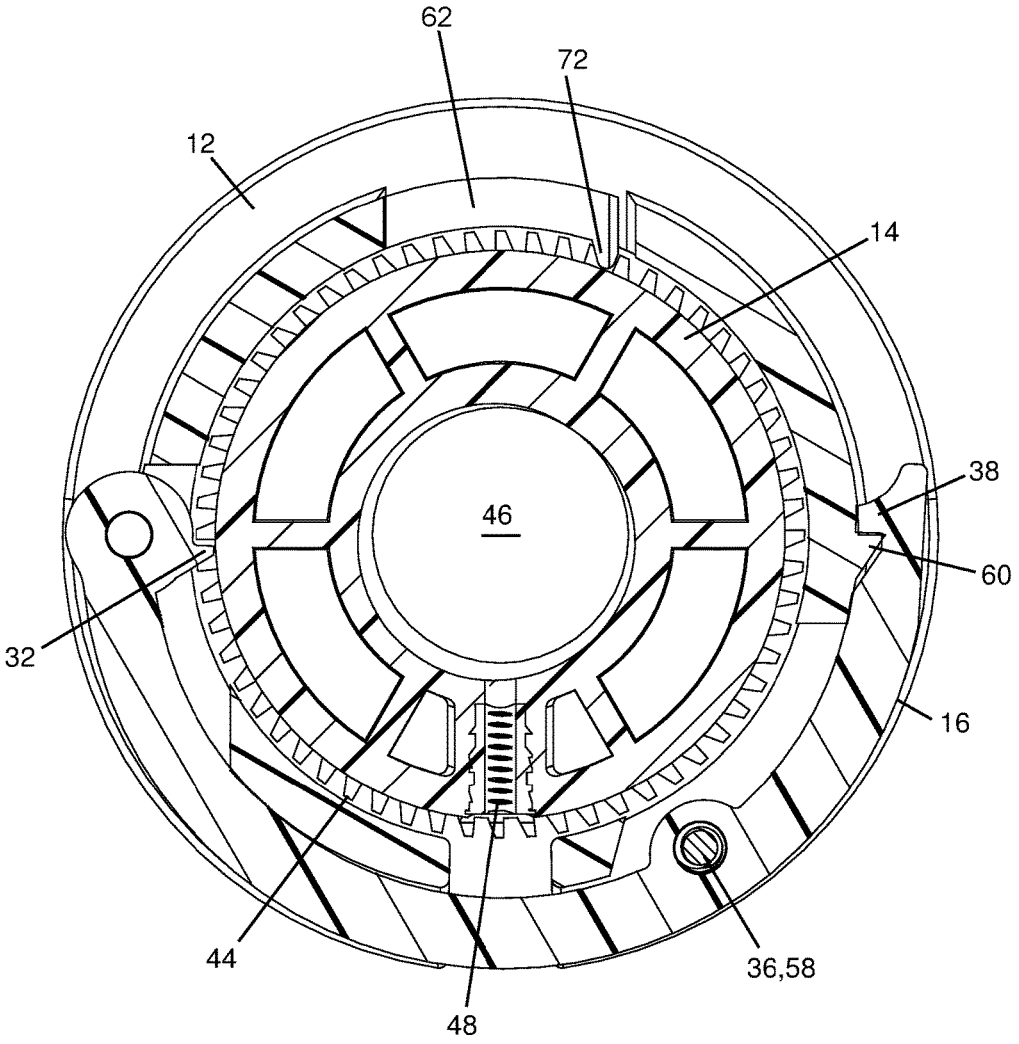
FIG. 6 shows a sectional view along line B-B of FIG. 4.

As illustrated in FIG. 6, and by way of example only, the locking lever 16 secures the mounting plate 14 in the mounting stake 12 and fixes the radial position of the mounting plate 14 when it is in the closed position. In the open position, however, the radial position of the mounting plate 14 may be adjusted by a user. As described above, the outer portion of the mounting plate 14 may include a plurality of teeth 44 which extend radially outwardly from the outer surface of the mounting plate 14. When the mounting plate 14 is positioned in the recessed portion 76 of the mounting stake 12, a tab 72 positioned in the recessed portion 76 engages with the teeth 44 such that the tab 72 fits into the space between adjacent teeth 44. The tab 72 allows for radial position of the mounting plate 14 to be incrementally adjusted relative to the mounting stake 12. The tab 72 fits into a first space between two adjacent teeth 44. The tab 72 can be any type of protrusion positioned along any part of the recessed portion 76 and/or locking lever 16.

The illustrated tab 72 is positioned at the end of a deflection arm 62. As the user exerts a rotational force on the mounting plate 14, a first tooth 44 adjacent to the tab 72 causes it to deflect, which allows the tab 72 to pass over the first tooth 44. The tab 72 then assumes its original position in a second space between adjacent teeth 44, the second space being adjacent to the first space. In this way the radial position of the mounting plate 14 can be incrementally adjusted, with the radial increment corresponding to the number of teeth 44 on outer portion of the mounting plate 14.

FIG. 6 depicts the locking lever 16 in a closed position. In this position the locking portion 32, which may be positioned on the hinged end of the locking lever 16 engages with an outer portion of the mounting plate 14. Here the locking portion 32 fits into the space between two adjacent teeth 44 on the outer portion of the mounting plate 14. If a rotational force is exerted on the mounting plate 14, the locking portion 32 will not deflect and will thereby prevent any of the plurality of teeth 44 from passing over it. In this way the locking portion 32 fixes the radial position of the mounting plate 14 when the locking lever 16 is in the closed position.

The locking lever 16 can be secured in the closed position by a locking tab 38 as shown in FIG. 6. The locking tab 38 slides over and then engages with a corresponding portion 60 of the mounting stake 12. In order to move the locking lever 16 into an open position again a user must exert enough force to cause the locking lever 16 to deflect such that the locking tab 38 is able to disengage from the corresponding portion 60 of the mounting stake 12. The end portion of the locking lever 16 may also include a finger pull to aid a user in forcing the locking tab 38 to disengage from the corresponding portion 60.

It will be understood that in some embodiments, the mounting stake may include only one or two of the tab 72, the locking portion 32, and the locking tab 38. Further, their functions can be combined into a single member, for example, a locking tab 38 and/or a locking portion 32 can have a first position to allow for incremental adjustment of the mounting plate 14 and a second position that prevents rotation of the mounting plate 14.

The locking lever 16 may be hingedly attached to the mounting stake 12 as depicted in FIG. 7. The locking lever 16 can include a barrel portion 64 which includes a through hole for allowing a pin 66 to pass therethrough. The pin 66 passes through an upper receiving portion 74 of the mounting stake 12 before it passes through the barrel portion 64 of the locking lever 16 and into a lower receiving portion of the mounting stake 12. In this way the locking lever 16 can rotate between the open position and the closed position about the pin 66 while the locking lever 16 is attached to the mounting stake 12. FIG. 7 further depicts the manner in which the mounting plate 14 may be inserted into the recessed portion 76 of the mounting stake 12 and the location of the securing screw 18.

The mounting stake 12 is depicted in FIG. 8. As described above, the mounting stake 12 includes a recessed portion 76 for receiving the mounting plate 14, with a tab 72 positioned inside the recessed portion 76 for engaging with the outer portion of the mounting plate 14. The tab 72 is able to deflect to allow for an incremental radial adjustment of the position of the mounting plate 14. Here the tab 72 is positioned at an end of a deflection arm 62 which is formed by a part of the recessed portion 76. The deflection arm 62 has a rectangular shape, although other shapes are expressly contemplated, and is affixed to the mounting stake 12 at an end opposite the tab 72. When a tooth 44 on the mounting plate 14 exerts a force on the tab 72, the deflection arm 62 can be bent outwardly away from the center of the mounting stake 12 to provide the deflection of the tab 72.

FIG. 8 also depicts the slot 54 in the mounting stake 12. As described above, the slot 54 is configured to allow the wire or wires connected to the light fixture 20 to pass therethrough when the light fixture 20 is affixed to the mounting plate 14 and in the recessed portion 76 of the mounting stake 12. The slot 54 extends from a top edge of the mounting stake 12 and extends continuously downwards to a position below the recessed portion 76 of the mounting stake 12. The slot 54 thereby leaves a gap in the portion of the mounting stake 12 surrounding the recessed portion 76, such that a wire exiting from the bottom of the mounting plate 14 can freely pass through the slot 54 as the mounting plate 14 is inserted into the recessed portion 76.

In an alternative configuration the mounting stake 12 comprises at least one tab, or tabs, which acts to secure the mounting plate 14 in the recessed attachment portion 76. As the mounting plate 14 is inserted into the attachment portion 76 the mounting plate 14 causes the tab, or tabs, to deflect and allow the mounting plate 14 to be seated in the attachment portion 76 whereupon the tab resumes its original position. In this configuration the locking lever 16 may not include any retaining portions 34 such that in the closed position the locking lever 16 only serves to fix the radial position of the mounting plate 14. In some embodiments, the mounting stake 12 may comprise a tab to secure the mounting plate 14 in the recessed attachment portion 76 and the locking lever may have retaining portions 34 to further secure the mounting plate 14 when the locking lever 16 is in the closed position.

Figure 9:
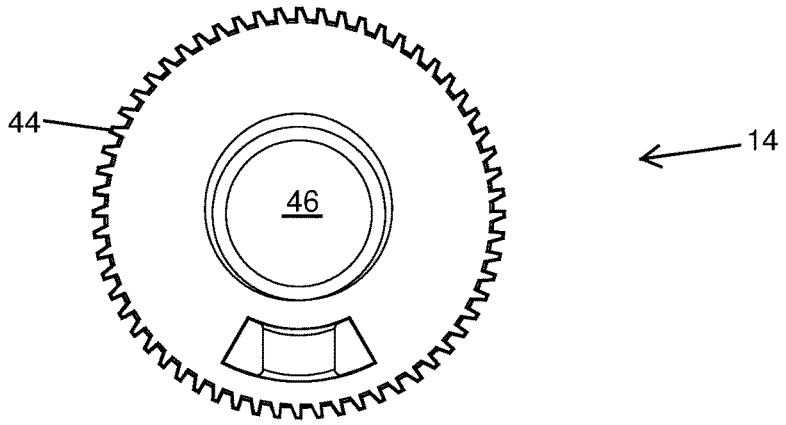
FIG. 9 is a top plan view of the mounting plate of the light fixture mount of FIG. 1.
Figure 10:
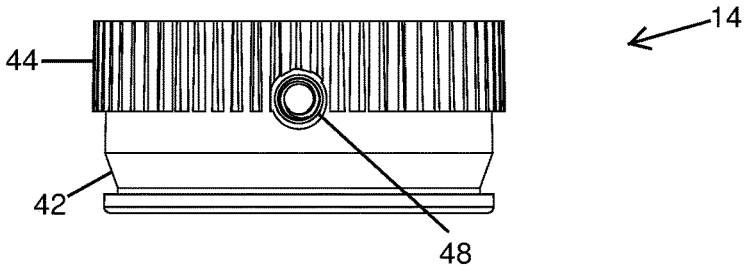
FIG. 10 is a side plan view of the mounting plate of the light fixture mount of FIG. 1.
Figure 11:
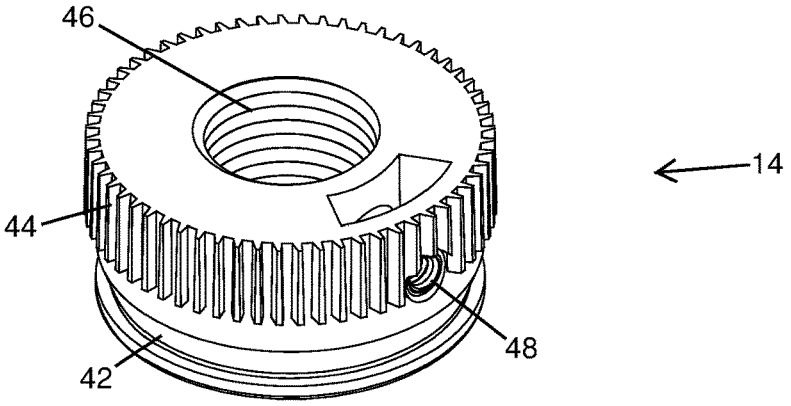
FIG. 11 shows an isometric view of the mounting plate of the light fixture mount of FIG. 1.

FIGS. 9-11 show the mounting plate 14 of the radially adjustable landscape light fixture mount 10 in isolation. FIG. 9 illustrates that the attachment portion 46 may be a centrally positioned through-hole that extends completely through the mounting plate 14. The attachment portion 46 may include female threads that correspond to the male threads on a light fixture 20. Alternatively, the attachment portion 46 may include a through-hole that does not include threads. Such a through-hole can include a counterbore positioned on a side opposite the light fixture 20. In use a male threaded portion of the light fixture 20 is inserted through the through-hole and a nut is screwed onto the light fixture 20 such that it sits in the counterbore. The counterbore allows the nut to secure the light fixture 20 to the mounting plate 14 while still maintaining the flat profile of the side of the mounting plate 14 opposite the light fixture 20.

FIGS. 10 and 11 illustrate an optional retaining groove 42 which extends around an outer perimeter of the mounting plate 14. The retaining groove 42 is a canted indentation with a lower lip which is shaped such that it corresponds to the shape of a retainer portion 34 (FIGS. 12-13) of the locking lever 16. In this way a retainer portion 34 can fit into the retaining groove 42 such that retainer portion 34 secures the mounting plate 14 in the recessed portion 76 of the mounting stake 12 when the locking lever 16 is in the closed position.

Figure 12:
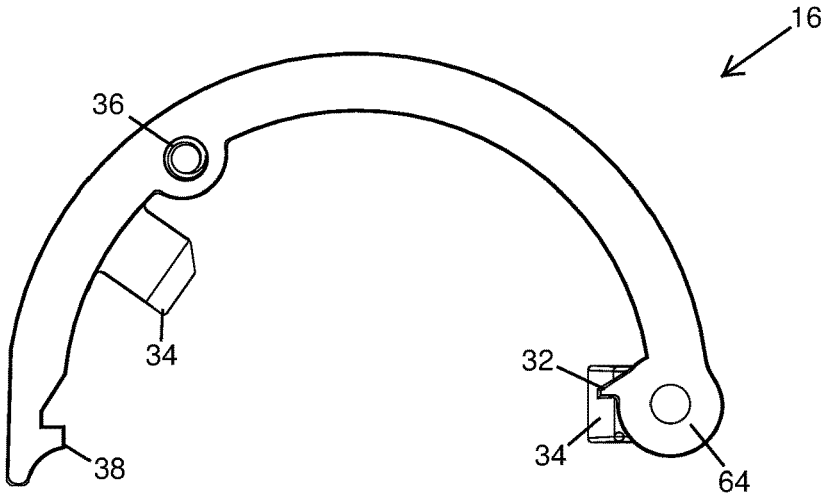
FIG. 12 is a top plan view of the locking lever of the light fixture mount of FIG. 1.
Figure 13:
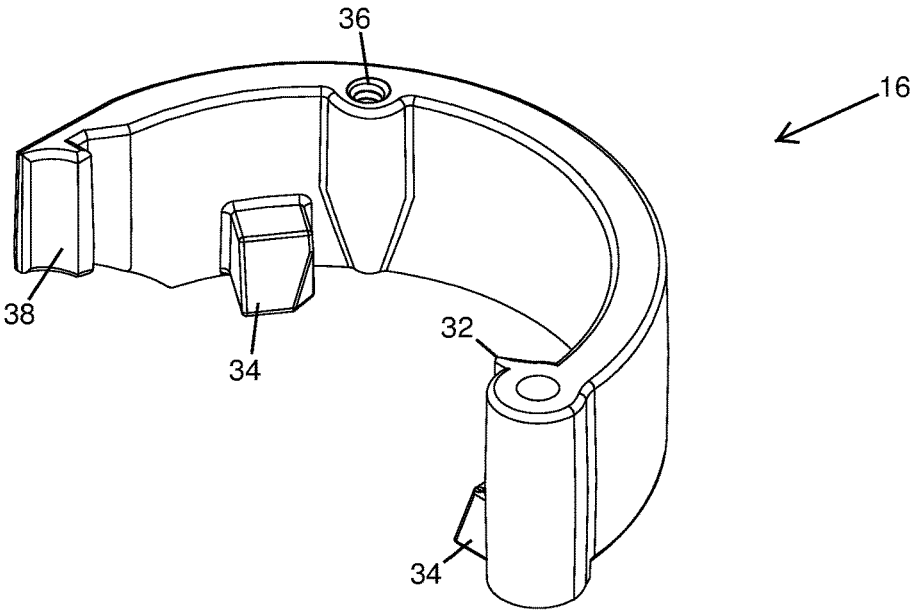
FIG. 13 depicts an isometric view of the locking lever of the light fixture mount of FIG. 1.

FIGS. 12-13 show the locking lever 16 of the radially adjustable landscape light fixture mount 10 in isolation. The locking lever 16 can includes one or more retaining portions 34 which protrude from the face of the locking lever 16 that faces the mounting plate 14 in use. The two illustrated retaining portions 34 have a substantially rectangular cross-section, although other cross-sectional shapes are expressly contemplated. The protruding end of a retaining portion 34 is canted such that it corresponds to the shape of the retaining groove 42 of the mounting plate 14. The bottom of each retaining portion 34 is thus positioned over the lip of the retaining groove 42 when the locking lever 16 is in the closed position to thereby secure the mounting plate 14 in the recessed portion 76 of the mounting stake 12. Other parts of the recessed portion 76, in addition to the locking lever 16, can also include one or more retaining portions 34.

The locking lever 16 includes a locking portion 32 which is positioned on the barrel portion 64 of the locking lever 16. The locking portion may be a protrusion having at least a flat side that presses against the side of a tooth 44 of the mounting plate 14. The locking lever 16 also includes a locking tab 38 positioned at the end of the locking lever 16 opposite the barrel portion 64. The locking tab 38 includes at least a flat side which presses against a corresponding flat portion of the mounting stake 12 to secure the locking lever 16 in the closed position.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A radially adjustable landscape light fixture mount, comprising:

a mounting plate comprising a plurality of teeth on an outer surface of the mounting plate and a female threaded portion configured to receive a male threaded portion of a light fixture; and a mounting stake for positioning a light fixture in a landscape comprising;

a top portion having a recess configured for receiving the mounting plate, the mounting plate being separate and removable from the mounting stake;

a tab located on an inner portion of the recess, the tab engaging with the teeth of the mounting plate when the mounting plate is positioned within the recess, the tab configured to allow for incremental adjustment of a radial position of the mounting plate; and a locking lever hingedly coupled to the top portion and having an open position and a closed position, the locking lever comprising;

a locking portion, wherein the locking portion engages with one or more teeth of the plurality of teeth to fix a radial position of the mounting plate when the mounting plate is positioned within the recess and the locking lever is in the closed position; and a locking tab configured to selectively fix and un-fix the locking lever in the closed position;

wherein the light fixture mount is further configured such that inserting the mounting plate into the recess establishes a longitudinal and latitudinal position of the mounting plate relative to the mounting stake, the mounting plate being rotatable in place within the recess to provide incremental adjustment until the locking lever is fixed in the closed position.

2. The light fixture mount of claim 1, wherein the tab comprises an arm attached to the top portion and a protrusion extending from the arm to sit between the teeth of the mounting plate, wherein the arm is configured to deflect to allow for the protrusion to pass over a tooth during an incremental radial adjustment of the mounting plate.

3. The light fixture of claim 1, wherein the outer surface of the mounting plate comprises a retaining groove and the locking lever comprises a retainer configured to fit in the retaining groove of the mounting plate to secure the mounting plate in the recess.

4. The light fixture mount of claim 1, wherein the mounting plate comprises a centrally located aperture extending through an entire thickness of the mounting plate configured to allow a wire connected to a light fixture to pass therethrough.

5. The light fixture mount of claim 4, wherein the mounting stake comprises a slot extending from a top edge of the top portion to an area below the recess in the top portion, the slot configured to allow the wire connected to the light fixture to pass therethrough.

6. A landscape lighting system, comprising:

the radially adjustable landscape light fixture mount of claim 1; and a light fixture comprising a male threaded portion coupled to the female threaded portion of the mounting plate.

7. The light fixture mount of claim 1, wherein the mounting stake is configured to be inserted into soil without the mounting plate attached and the mounting plate is configured to receive a light fixture prior to being inserted into the recess in the top portion of the mounting stake.

8. A radially adjustable landscape light fixture mount, comprising:

a mounting plate comprising a light fixture attachment portion configured to fixedly receive a light fixture;

a mounting stake configured to receive the mounting plate; and a lock having an unlock position and a lock position, wherein the lock is configured to secure the mounting plate to the mounting stake and to fix a radial position of the mounting plate in the lock position;

wherein the mounting plate is separate and removable from the mounting stake and being rotatable when received by the mounting stake with respect to the mounting stake, and wherein the mounting plate is configured to be received by a recess in the mounting stake.

9. The light fixture mount of claim 8, wherein the light fixture mounting plate comprises a plurality of teeth.

10. The light fixture mount of claim 9, wherein the top portion comprises a tab that engages with the teeth of the mounting plate to allow for an incremental adjustment of the radial position of the mounting plate when in the recess.

11. The light fixture mount of claim 10, wherein the lock comprises a retaining tab that engages with the teeth of the mounting plate.

12. The light fixture mount of claim 8, wherein the lock comprises a rotatable C shaped clip having a locking tab configured to engage with a corresponding portion of the mounting stake to thereby secure the lock in the lock position.

13. The light fixture mount of claim 8, wherein the mounting plate comprises a centrally located aperture extending through an entire thickness of the mounting plate to receive and pass through a wire connected to a light fixture.

14. The light fixture mount of claim 13, wherein the mounting stake comprises a slot extending from a top edge of the top portion to below the recess, the slot configured to allow the wire connected to the light fixture to pass through the slot.

15. A landscape lighting system, comprising:

the radially adjustable landscape light fixture mount of claim 8; and a light fixture configured to be fixedly attached to the light fixture attachment portion of the light fixture mounting plate.

16. A radially adjustable landscape light fixture mount, comprising:

a mounting plate comprising;

an attachment portion for fixedly receiving a light fixture;

an outer portion comprising a plurality of teeth; and a retaining groove;

a mounting stake comprising;

a top portion configured for receiving the mounting plate;

a locking lever having an open position and a closed position, the locking lever comprising;

a locking portion that engages with one or more teeth of the plurality of teeth in the closed position to fix a radial position of the mounting plate; and a retainer portion that fits into the retaining groove of the mounting plate when the mounting plate is received at the top portion and the locking lever is in the closed position to fix and secure the mounting plate at the top portion; and a tab that engages with the teeth of the mounting plate when the mounting plate is received at the top portion, wherein the tab allows for an incremental adjustment of the radial position of the mounting plate while the locking lever is in the open position;

wherein the mounting plate is separate and removable from the mounting stake; and wherein the light fixture mount is further configured such that positioning the mounting plate at the top portion establishes a longitudinal and latitudinal position of the mounting plate relative to the mounting stake, the mounting plate being rotatable until the locking lever is fixed in the closed position.

17. The landscape light fixture mount of claim 16, wherein the top portion configured for receiving the mounting plate comprises a recess.

18. A landscape lighting system, comprising:

the radially adjustable landscape light fixture mount of claim 16; and a light fixture configured to be fixedly attached to the attachment portion of the mounting plate.

19. The light fixture mount of claim 16, wherein the mounting stake is configured to be inserted into soil without the mounting plate attached and the mounting plate is configured to receive a light fixture prior to being inserted into the recess in the top portion of the mounting stake.

* * * * *